US007207705B2

(12) United States Patent
Ishida

(10) Patent No.: US 7,207,705 B2
(45) Date of Patent: Apr. 24, 2007

(54) VEHICLE ILLUMINATION LAMP

(75) Inventor: Hiroyuki Ishida, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 11/254,777

(22) Filed: Oct. 21, 2005

(65) Prior Publication Data

US 2006/0087860 A1 Apr. 27, 2006

(30) Foreign Application Priority Data

Oct. 27, 2004 (JP) ..... P2004-312837

(51) Int. Cl.
*F21V 7/00* (2006.01)

(52) U.S. Cl. ..... 362/517; 362/518; 362/298; 362/300; 362/346

(58) Field of Classification Search ..... 362/516, 362/517, 518, 297, 298, 299, 300, 346
See application file for complete search history.

(56) References Cited

U.S. PATENT DOCUMENTS 6,457,850 B2 * 10/2002 Oyama et al. ..... 362/517
6,523,977 B2 * 2/2003 Chuang et al. ..... 362/231
6,527,426 B2 * 3/2003 Oyama et al. ..... 362/517
6,558,032 B2 * 5/2003 Kondo et al. ..... 362/516
6,575,608 B2 * 6/2003 Oyama et al. ..... 362/517

FOREIGN PATENT DOCUMENTS

JP 2001-332104 A 11/2001

* cited by examiner

*Primary Examiner*—Thomas M. Sember
(74) *Attorney, Agent, or Firm*—Sughrue Mion, PLLC

(57) ABSTRACT

A vehicle illumination lamp having a light-emitting element including an optical axis, a first reflection surface, a second reflection surface, and a third reflection surface. The third reflecting surface is formed on a plane intersecting the optical axis in such a manner as to include a first focal point and a second focal point of the first reflecting surface.

16 Claims, 8 Drawing Sheets

VEHICLE ILLUMINATION LAMP

This application claims foreign priority from Japanese Patent Application No. 2004-312837, filed Oct. 27, 2004, the entire disclosure of which is herein incorporated by reference.

BACKGROUND OF THE INVENTION

1. Field of the Invention

The present invention relates to a vehicle illumination lamp employing a light-emitting element, such as a light-emitting diode, as a light source.

2. Description of Related Art

In recent years, an illumination lamp employing a light-emitting element, such as a light-emitting diode, as a light source has been developed as a vehicle illumination lamp, such as a headlamp.

In relation to the above, Japanese Patent Publication 2001-332104 discloses a vehicle illumination lamp having a first reflection surface for reflecting light from a light-emitting element, which is disposed facing a lateral direction of the lamp, rearward in relation to the lamp and a second reflection surface for reflecting in a forward direction in relation to the lamp light originated from the light-emitting element and reflected by the first reflection surface. In the vehicle illumination lamp disclosed in JP 2001-332104, the first reflection surface is formed into a spheroid with a first focal point that is at a luminous center of the light-emitting element and with a second focal point that is at a point located in a lateral direction of the first focal point; and the second reflection surface is formed into a paraboloid of revolution with a focal point that is the second focal point.

By means of employing such a vehicle illumination lamp, light illuminated from the vehicle illumination lamp can be controlled while a utilization rate of the light flux is increased in relation to light from the light-emitting element.

However, this configuration of the vehicle illumination lamp involves a problem that a light distribution pattern having a sharp cutoff line cannot be formed from light illuminated from the vehicle illumination lamp.

SUMMARY OF THE INVENTION

The present invention has been conceived in view of the above circumstances, and aims at providing a vehicle illumination lamp, which employs a light-emitting element as a light source, being capable of forming a light distribution pattern having a sharp cutoff line, in addition to increasing a utilization rate of the light flux in relation to light from the light-emitting element.

The present invention aims at achieving the object by making contrivance to an orientation of the light-emitting element and to an arrangement of the first and second reflection surfaces, and by means of disposing a given third reflection surface below the light-emitting element.

More specifically, the present invention provides a vehicle illumination lamp having a light-emitting element which is disposed on an optical axis extending in a longitudinal direction of the lamp in plane view and so as to face rearward in relation to the lamp, a first reflection surface for reflecting in a downward direction light originating from the light-emitting element, and a second reflection surface for reflecting in a forward direction in relation to the lamp light originated from the light-emitting element and reflected by the first reflection surface, and a third reflection surface, which is formed from a plane intersecting the optical axis in such a manner as to include a first focal point and a second focal point, and which is disposed below the light-emitting element so as to face rearward in relation to the lamp. A vertical cross-sectional profile of the first reflection surface along the optical axis is formed into a substantially elliptical shape whose first focal point is at a point in the vicinity of an illuminance center of the light-emitting element and whose second focal point is at a point located below the first focal point; a vertical cross-sectional profile of the second reflection surface along the optical axis is formed into a substantially parabolic shape whose focal point is the second focal point; and a lower edge of the third reflection surface is formed so as to extend in a horizontal direction at a vertical level of the second focal point.

The vehicle illumination lamp is not limited to any specific type. For instance, a headlamp, a fog lamp, a cornering lamp, a daytime running lamp, or the like; or a lamp unit which forms a portion thereof, or the like, can be employed.

The optical axis of the lamp is not necessarily limited to an axis which extends horizontally in side view, so long as it is an axis extending in the longitudinal direction of the lamp in plane view.

The light-emitting element can be an element-like light source having a light-emitting chip which illuminates substantially in the form of a point, and is not limited to any specific type. For instance, a light-emitting diode, a laser diode, or the like can be employed.

Not specific limitation is imposed to a horizontal cross-sectional profile of the first reflection surface, so long as a vertical cross-sectional profile of the same along the optical axis is formed into a substantially elliptical shape whose first focal point is at a point in the vicinity of the illuminance center of the light-emitting element and whose second focal point is at a point located below the first focal point.

No specific limitation is imposed to a horizontal cross-sectional profile of the second reflection surface, so long as a vertical cross-sectional profile of the same along the optical axis is formed into a substantially parabolic shape whose focal point is at the second focal point.

A plane forming the third reflection surface intersects the optical axis in such a manner as to include the first and the second focal points. Hence, the plane may be a vertical plane which is orthogonal to the optical axis, or a plane which is longitudinally or laterally tilted in relation to the vertical plane by a certain angle.

BRIEF DESCRIPTION OF THE DRAWINGS

The advantages, nature and various additional features of the invention will appear more fully upon consideration of the exemplary embodiment of the invention and modifications thereof, which are schematically set forth in the drawings, in which.

DETAILED DESCRIPTION OF THE EXEMPLARY EMBODIMENT

Although the invention will be described below with reference to the exemplary embodiment and modifications thereof, the following exemplary embodiment and modifications do not restrict the invention.

As to the term of "translucent" in this invention, it is noted that said term shall be construed rather broadly such as to cover the meaning of "transparent" whose optical characteristic might be included in the definition of "translucent" that is known for a person skilled in the art.

Figure 1:
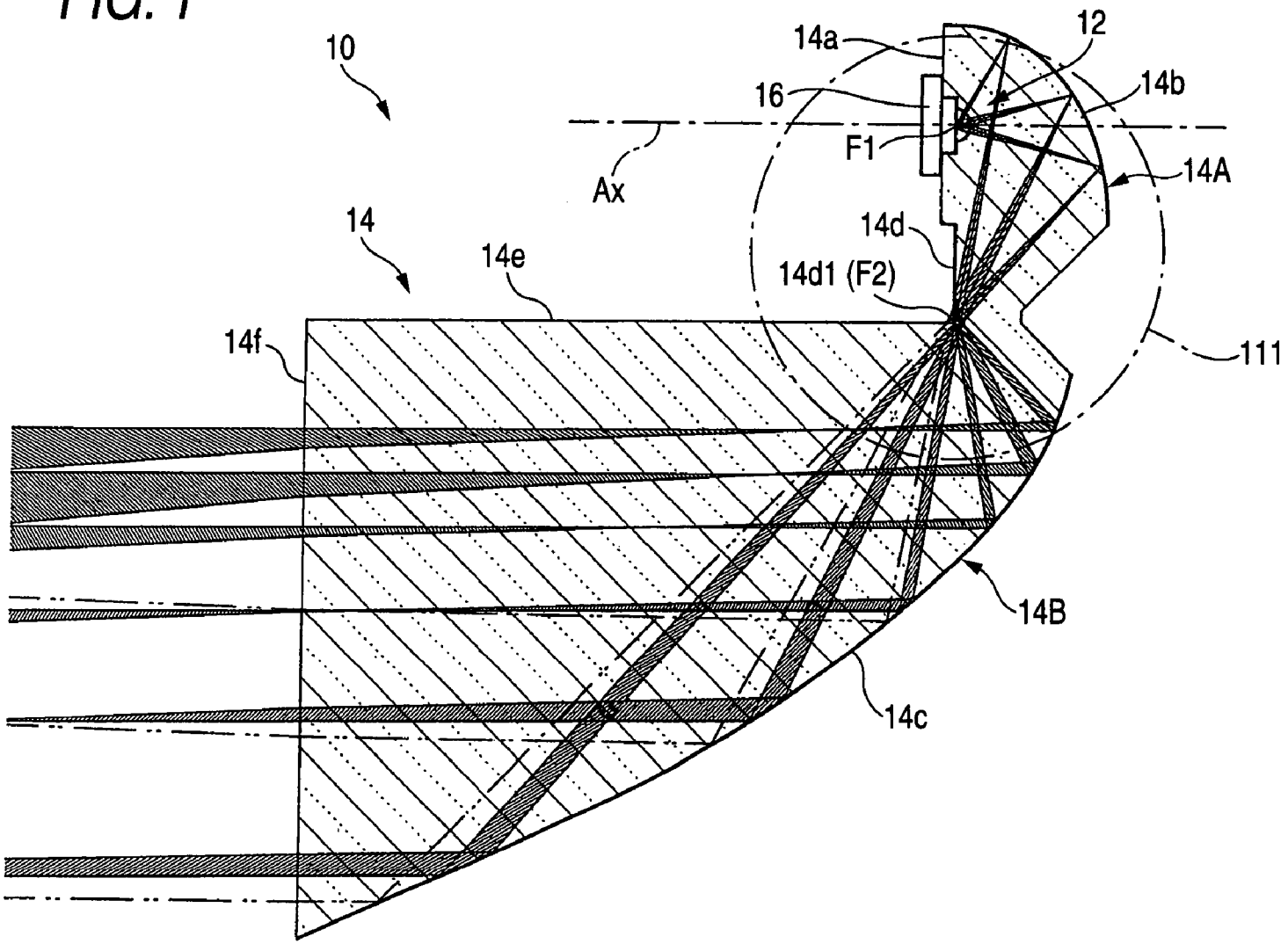
FIG. 1 is a side cross-sectional view illustrating a vehicle illumination lamp according to an exemplary embodiment of the present invention.
Figure 2:
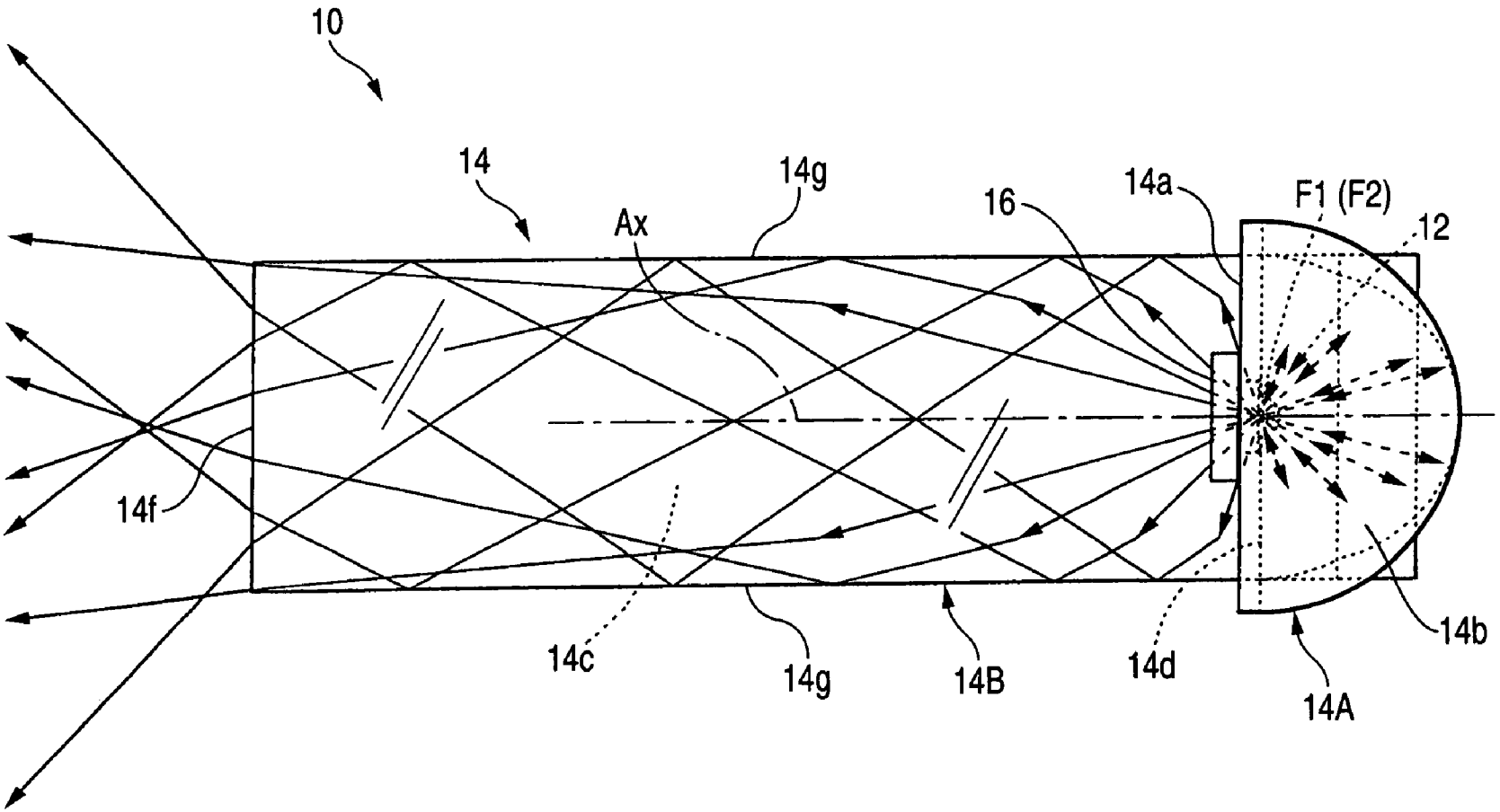
FIG. 2 is a plane view illustrating the vehicle illumination lamp.
Figure 3:
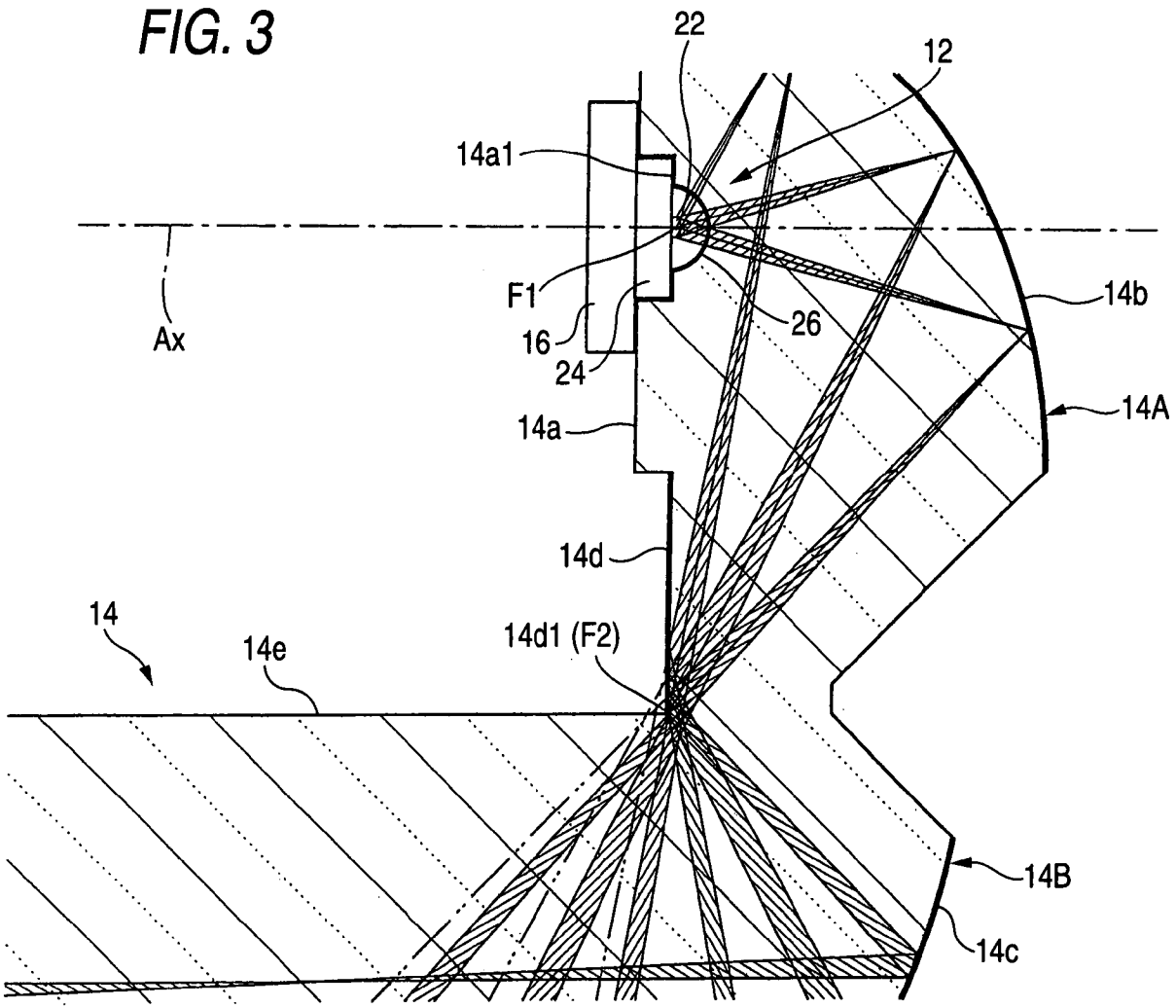
FIG. 3 is a detailed view showing a portion III of FIG. 1.
Figure 4:
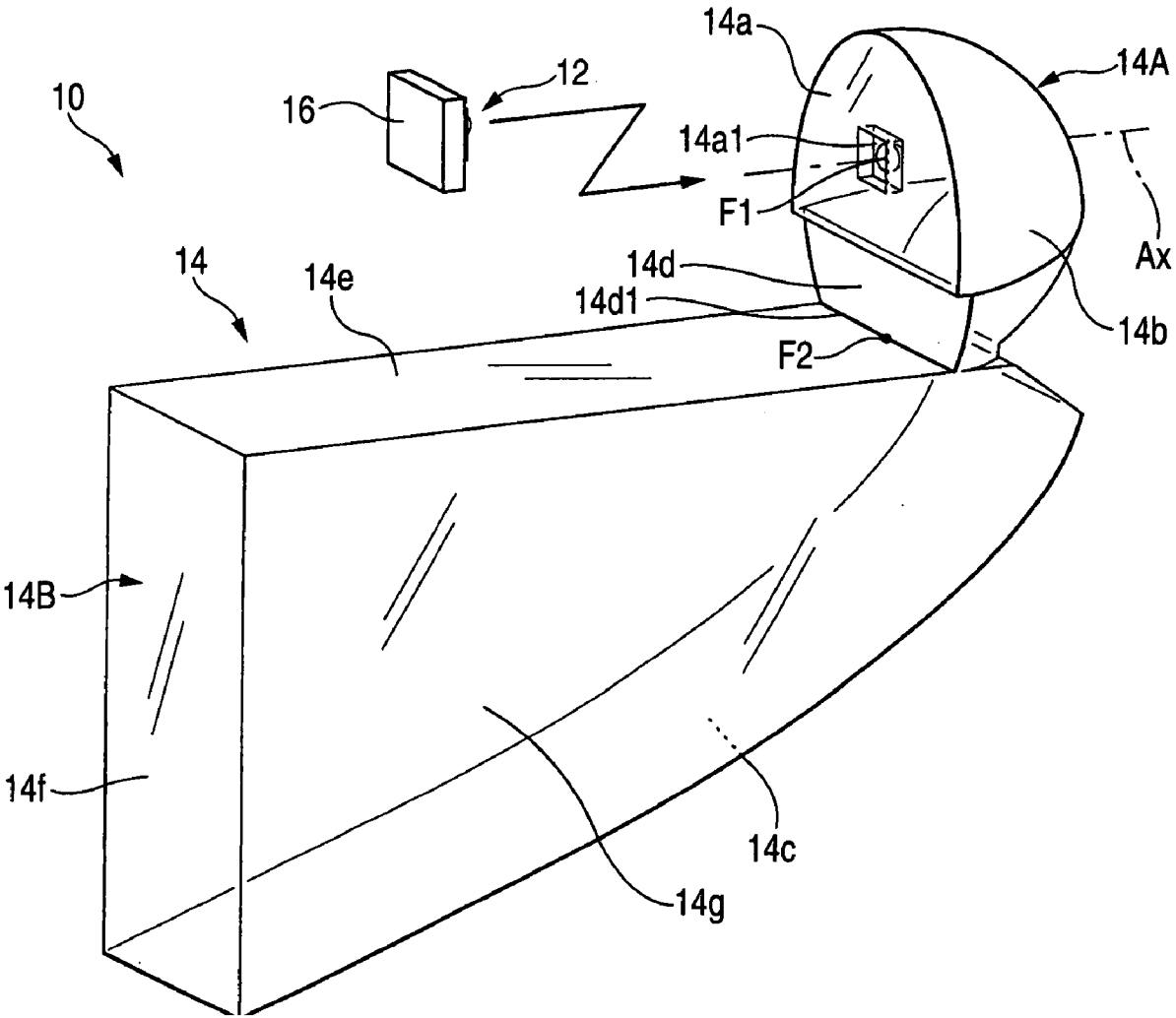
FIG. 4 is an exploded perspective view illustrating the vehicle illumination lamp.

FIG. 1 is a side cross-sectional view illustrating a vehicle illumination lamp 10 according to an embodiment of the invention, FIG. 2 is a plane view illustrating the same, and FIG. 3 is a detailed view of a portion III of FIG. 1. FIG. 4 is an exploded perspective view illustrating the vehicle illumination lamp 10.

As illustrated in these drawings, the vehicle illumination lamp 10 is a lamp unit to be used as a portion of a headlamp. The vehicle illumination lamp 10 comprises a light-emitting element 12 which is disposed on an optical axis Ax extending in a longitudinal direction of the lamp and a translucent block 14 for fixedly supporting the light-emitting element 12. The light emitting element faces rearward in relation to the lamp 10. The vehicle illumination lamp 10 is configured such that, in a state of being assembled into a headlamp, the optical axis Ax extends in a direction oriented approximately 0.5 to 0.6 degrees downward in relation to the longitudinal direction of the vehicle.

The light-emitting element 12 is a white light-emitting diode having a light-emitting chip 22 measuring about 0.3 to 3 mm square; a base member 24 for mounting the light-emitting chip 22 thereon; and a sealing resin member 26 for sealing the light-emitting chip 22. The light-emitting element 12 is fixed onto the translucent block 14 via a support plate 16.

The translucent block 14, which is a block-shaped member formed from a translucent resin, is formed from an upper structural section 14A and a lower section 14B.

A light-source mount surface 14*a* is formed on the upper front face of the upper structural section 14A.

The light-source mount surface 14*a* is a flat surface for mounting the light-emitting element 12 thereon, and formed as a vertical flat surface orthogonal to the optical axis Ax. A concave section 14*a*1 conforming with the surface shape of the light-emitting element 12 is formed in the light-source mount surface 14*a* at a position on the optical axis Ax. The light-emitting element 12 is configured so as to be fixed into the light-source mount surface 14*a* via the support plate 16 in a state of being inserted in the concave section 14*a*1.

A reflection film which forms a first reflection surface 14*b* is formed on the upper rear face of the upper structural section 14A.

The first reflection surface 14*b* is a reflection surface for reflecting in a downward direction light originating from the light-emitting element 12. The first reflection surface 14*b* is formed into a spheroid whose first focal point F1 is at a luminous center (i.e., a center position of the light-emitting chip 22) of the light-emitting element 12, and whose second focal point F2 is at a point located vertically below the first focal point F1. The first reflection surface 14*b* is formed by means of performing mirror-surface treatment by means of aluminum deposition, or the like, on the upper rear face of the upper structural section 14A.

A reflection film which forms a third reflection surface 14*d* is formed on the lower front face of the upper structural section 14A.

The third reflection surface 14*d* is a reflection surface for specularly reflecting in a rearward direction in relation to the lamp a portion of light originated from the light-emitting element 12 and having been specularly reflected by the first reflection surface 14*b*. The third reflection surface 14*d* is formed into a vertical plane intersecting the optical axis Ax in such a manner as to include the first and the second focal points F1 and F2. A lower edge 14*d*1 of the third reflection surface 14*d* is formed so as to extend in a horizontal direction at a vertical level of the second focal point F2. The third reflection surface 14*d* is formed by means of performing mirror-surface treatment by means of aluminum deposition, or the like, on the lower front face of the upper structural section 14A.

Meanwhile, a reflection film which forms a second reflection surface 14*c* is formed on the rear face of the lower section 14B.

The second reflection surface 14*c* is a reflection surface for reflecting in a forward direction in relation to the lamp light originated from the light-emitting element 12 and reflected by the first reflection surface 14*b*. The second reflection surface 14*c* is formed into a substantially parabolic, cylindrical curved surface shape whose focal line is at the lower edge 14*d*1 of the third reflection surface 14*d*. The second reflection surface 14*c* is formed by means of performing mirror-surface treatment by means of aluminum deposition, or the like, on the rear face of the lower section 14B.

The lower section 14B is formed into a thick-plate shape. An upper face 14*e* of the lower section 14B is formed from a plane extending forward and in a direction parallel to the optical axis Ax from the lower edge 14*d*1 of the third reflection surface 14*d*. A front face 14*f* of the lower section 14B is formed from a vertical plane orthogonal to the optical axis Ax; and each of side faces 14*g* on the right and left sides thereof is formed from a vertical plane parallel to the optical axis Ax.

Next, working effects yielded by the present exemplary embodiment will be described.

In the vehicle illumination lamp 10, much of light originating from the light-emitting chip 22 of the light-emitting element 12 reaches the first reflection surface 14*b*, and is reflected in the downward direction by the first reflection surface 14*b*. At this time, since the first reflection surface 14 is formed from a spheroid whose first focal point F1 is at the luminous center of the light-emitting element 12, and whose second focal point F2 is at the point located vertically below the first focal point F1, the light reflected from the first reflection surface 14*b* temporarily converges to the second focal point F2, and thereafter reaches the second reflection surface 14*c* as light having diverged from the second focal point F2.

In this case, since the light-emitting chip 22 is small, substantially half of the light reflected by the first reflection surface 14*b* directly reaches the second reflection surface

14*c*. Meanwhile, the remaining substantially half of the light reaches the third reflection surface 14*d* disposed below the light-emitting element 12 and, after being specularly reflected by the third reflection surface 14*d*, reaches the second reflection surface 14*c*. At this time, a demarcation between light to directly reach the second reflection surface 14*c* and light to reach the second reflection surface 14*c* by way of the third reflection surface 14*d* is made at the lower edge 14*d*1 of the third reflection surface 14*d*. Since the lower edge 14*d*1 extends in the horizontal direction at the vertical level of the second focal point F2, a horizontally-elongated light distribution pattern (which will be described later) having a sharp cutoff line can be formed from light reflected by the second reflection surface 14*c*.

More specifically, since the second reflection surface 14*c* is formed from the parabolic, cylindrical curved surface whose focal line is at the lower edge 14*d*1 of the third reflection surface 14*d*, light incident on the second reflection surface 14*c* from the position of the second focal point F2 is reflected in a direction parallel to the optical axis Ax with respect to the vertical direction. Light incident on the second reflection surface 14*c* from a position forward of the second focal point F2 is reflected upward in relation to the optical axis Ax; in contrast, light incident on the second reflection surface 14*c* from a position rearward of the second focal point F2 is reflected downward in relation to the optical axis Ax. At this time, since the lower edge 14*d*1 of the third reflection surface 14*d* is formed so as to extend in the horizontal direction at the vertical level of the second focal point F2, all the light reflected by the first reflection surface 14*b* can be caused to reach the second reflection surface 14*c* as light from positions to the rear of the second focal point F2. Hence, light reflected from the second reflection surface 14*c* can be prevented from becoming light oriented upward in relation to the optical axis Ax.

Since the second reflection surface 14*c* is formed from the parabolic, cylindrical curved surface whose focal line is the lower edge 14*d*1 of the third reflection surface 14*d*, light incident on the second reflection surface 14*c* is reflected in a direction moving away from the optical axis Ax with respect to the horizontal direction. Some of the light reflected by the second reflection surface 14*c* directly reaches the front face 14*f*, and exits from the front face 14*f* in a forward direction of the lamp. The remaining light is reflected by one or both of the side faces 14*g* on the right and left sides once or a plurality of times, thereafter reaches the front face 14*f*, and exits from the front face 14*f* in a forward direction of the lamp. By virtue of this configuration, light having exited from the front face 14*f* becomes light which is widely diffused in the lateral direction.

Figure 5:
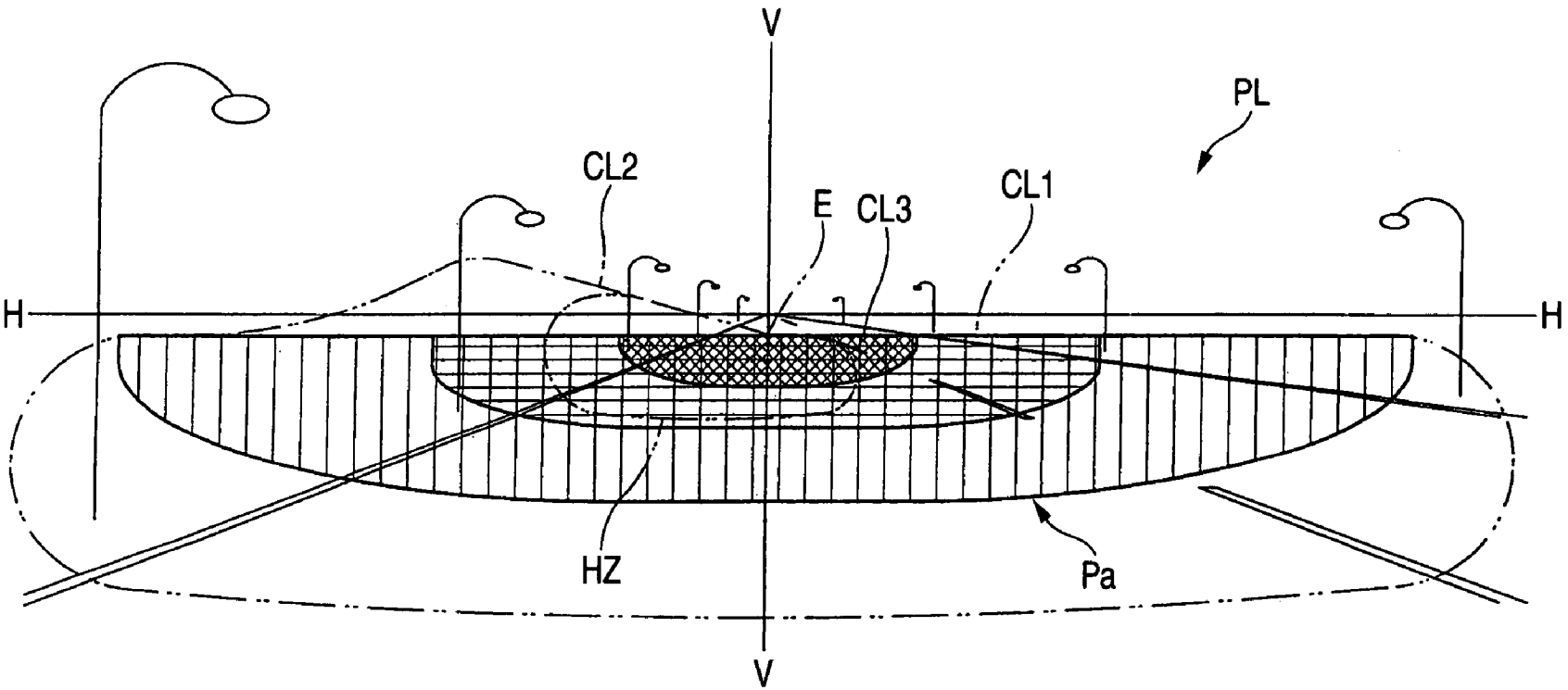
FIG. 5 is a perspective view illustrating a light distribution pattern formed from light illuminated forward from the vehicle illumination lamp on a virtual vertical screen placed at a position 25*m* ahead of the vehicle.

FIG. 5 is a perspective view illustrating a light distribution pattern Pa formed from light illuminated forward from the vehicle illumination lamp 10 on a virtual vertical screen placed at a position 25*m* ahead of the vehicle.

As illustrated in the drawing, the light distribution pattern Pa is formed as a portion of a low-beam light distribution pattern PL indicated by a line constituted of short and long dashes. The low-beam light distribution pattern PL is a light distribution pattern formed from light illuminated from the entire headlamp including the vehicle illumination lamp 10.

The low-beam light distribution pattern PL is a left-oriented low-beam light distribution pattern. The low-beam light distribution pattern PL has a horizontal cutoff line CL1 and an oblique cutoff line CL2 at an upper edge thereof. An elbow point E, which is a point of intersection of the cutoff lines CL1 and CL2, is set to a location situated slightly below (more specifically, about 0.5 to 0.6 degrees below) a point H-V, which is a vanishing point in the frontward direction of the vehicle. A hot zone HZ is formed in the low-beam light distribution pattern PL so as to surround the elbow point E within an area slightly to the left thereof.

Meanwhile, a light distribution pattern Pa is a horizontally-elongated light distribution pattern having its center below and in the vicinity of the elbow point E. The light distribution pattern Pa has a cutoff line CL3 which extends in the horizontal direction at the upper edge thereof.

The reason for the light distribution pattern Pa being formed into a horizontally-elongated light distribution pattern is that the second reflection surface 14*c* is formed from the parabolic, cylindrical curved surface whose focal line is at the lower edge 14*d*1 of the third reflection surface 14*d*, whereby light having exited from the front face 14*f* is widely diffused in the lateral direction. In addition, the reason for formation of the cutoff line CL3 extending in the horizontal direction in the light distribution pattern Pa is that, at the lower edge 14*d*1 of the third reflection surface 14*d*, the light reflected by the first reflection surface 14*b* is divided into the light to directly reach the second reflection surface 14*c* and the light to reach the second reflection surface 14*c* by way of the third reflection surface 14*d*. In addition, the cutoff line CL3 is located at a vertical level substantially equal to that of the horizontal cutoff line CL1. The reason therefor is that the optical axis Ax of the vehicle illumination lamp 10 is disposed so as to extend in a direction oriented approximately 0.5 to 0.6 degrees downward in relation to the longitudinal direction of the vehicle.

Meanwhile, in the light distribution pattern Pa, a plurality of curves formed substantially concentrically with a curve representing the outline of the light distribution pattern Pa are iso-intensity curves. The iso-intensity curves indicate that the light distribution pattern Pa gradually becomes brighter from the outer peripheral edge to the center thereof.

As described above in detail, the vehicle illumination lamp 10 according to the exemplary embodiment has the light-emitting element 12 which is disposed on the optical axis Ax extending in a longitudinal direction of the lamp in plane view so that the light-emitting element 12 faces rearward in relation to the lamp; the first reflection surface 14*b* for reflecting in a downward direction light from the light-emitting element 12; and the second reflection surface 14*c* for reflecting in a forward direction in relation to the lamp light originated from the light-emitting element 12 and reflected by the first reflection surface 14*b*. However, the vertical cross-sectional profile of the first reflection surface 12*b* along the optical axis Ax is formed into an elliptical shape whose first focal point F1 is at the luminescence center of the light-emitting element 12, and whose second focal point F2 is at the point located below the first focal point F1. The vertical cross-sectional profile of the second reflection surface 14*c* along the optical axis Ax is formed into a parabolic shape whose focal point is at the second focal point F2. Accordingly, light illuminated from the vehicle illumination lamp 10 can be controlled while increasing a utilization rate of the light flux in relation to light from the light-emitting element 12.

In relation to the above, in the vehicle illumination lamp 10 according to the present exemplary embodiment, provided below the light-emitting element 12 is the third reflection surface 14*d* formed from a vertical plane which orthogonally intersects the optical axis Ax in such a manner as to include the first and the second focal points F1 and F2. In addition, the lower edge 14*d*1 of the third reflection surface 14*d* is formed so as to extend in the horizontal direction at the vertical level of the second focal point F2. Therefore, the following working effects can be yielded.

Namely, substantially half of the light reflected by the first reflection surface 14*b* directly reaches the second reflection surface 14*c*. In contrast, the remaining substantially half of the reflected light enters the third reflection surface 14*d* disposed below the light-emitting element 12; and after being specularly reflected by the third reflection surface 14*d*, enters the second reflection surface 14*c*. At this time, a demarcation between light that directly enters the second reflection surface 14*c* and light that enters the second reflection surface 14*c* by way of the third reflection surface 14*d* is made at the lower edge 14*d*1 of the third reflection surface 14*d*. Since the lower edge 14*d*1 extends in the horizontal direction at the vertical level of the second focal point F2, as already having been described in detail, the light distribution pattern Pa having the sharp cutoff line CL3 can be formed from light reflected by the second reflection surface 14*c*.

Thus, according to the present exemplary embodiment, the vehicle illumination lamp 10, which employs the light-emitting element 12 as a light source, can form the light distribution pattern Pa having the sharp cutoff line CL3 while increasing a utilization rate of the light flux in relation to light from the light-emitting element 12.

In relation to the above, since in the present exemplary embodiment the first reflection surface 14*b* is formed into a spheroid, all the light reflected by the first reflection surface 14*b* can be caused to converge to the second focal point F2. Accordingly, even when the second reflection surface 14*c* is formed into the parabolic, cylindrical curved surface shape whose focal line is the lower edge 14*d*1 of the third reflection surface 14*d* as in the case of the present embodiment, the cutoff line CL3 of the light distribution pattern Pa formed from light reflected by the second reflection surface 14*c* can be rendered highly sharp.

In the present exemplary embodiment, since the second reflection surface 14*c* is formed into substantially a parabolic cylindrical curved surface shape whose focal line is the lower edge 14*d*1 of the third reflection surface 14*d*, the light distribution pattern Pa having the sharp cutoff line CL3 can be formed as a light distribution pattern having a large lateral diffusion angle.

In addition, in the present exemplary embodiment, each of the first, second, and third reflection surfaces 14*b*, 14*c*, and 14*d* is formed from a reflection film formed on the surface of the single translucent block 14. Accordingly, the above-mentioned working effects can be yielded while reducing the number of components of the vehicle illumination lamp 10. In addition, as compared with a case where each of the first, second, and third reflection surfaces 14*b*, 14*c*, and 14*d* is formed on respective surfaces of different members, accuracy in positional relationship between the reflection surfaces 14*b*, 14*c*, 14*d* can be enhanced. By virtue of this configuration, the light distribution pattern Pa having the highly-sharp cutoff line CL3 can be formed easily.

Meanwhile, the present exemplary embodiment has been described on an assumption that the light-emitting chip 22 of the light-emitting element 12 is formed into a square measuring about 0.3 to 3 mm per side. However, the light-emitting chip formed into another external shape (e.g., a horizontally-elongated rectangular shape) can also be employed.

The present exemplary embodiment has been described based on the assumption that the second reflection surface 14*c* is formed into the parabolic, cylindrical curved surface shape whose focal line is the lower edge 14*d*1 of the third reflection surface 14*d*. Alternatively, as a matter of course, the second reflection surface 14*c* may be formed into another shape. For instance, the second reflection surface 14*c* can be formed into a paraboloid of revolution whose focal point is the second focal point F2 and whose center axis is parallel to the optical axis Ax. When such a surface shape is employed, a spot-like light distribution pattern having a highly-sharp cutoff line can be formed.

In addition, the exemplary embodiment has been described based on the assumption that the front face 14*f* of the lower section 14B is formed from a vertical plane orthogonal to the optical axis Ax. Alternatively, another configuration in which diffuse deflection control of light exited from the lower section 14B is performed through utilization of the front face 14*f* is also applicable. For instance, when a plurality of diffusion lens elements are formed on the front face 14*f* so as to form a vertical stripe pattern, there can be formed a light distribution pattern having a lateral diffusion angle which is larger than that of the light distribution pattern Pa.

Meanwhile, the exemplary embodiment has been described on an assumption that the vehicle illumination lamp 10 is formed as a portion of a headlamp. Alternatively, the same illumination lamp 10 can be formed as a lamp independent of a headlamp as in the case of, e.g., a cornering lamp. In relation thereto, the exemplary embodiment has also been described on an assumption that the vehicle illumination lamp 10 is employed in a state of facing frontward of the vehicle. Alternatively, the vehicle illumination lamp 10 can be used, for example, in a state of facing outward in the lateral direction of the vehicle by a predetermine angle in relation to the longitudinal direction of the vehicle. When this configuration is employed, the vehicle illumination lamp 10 can be rendered more suitable as a cornering lamp.

Next, modifications of the exemplary embodiment will be described.

First, a first modification of the above exemplary embodiment will be described.

Figure 6:
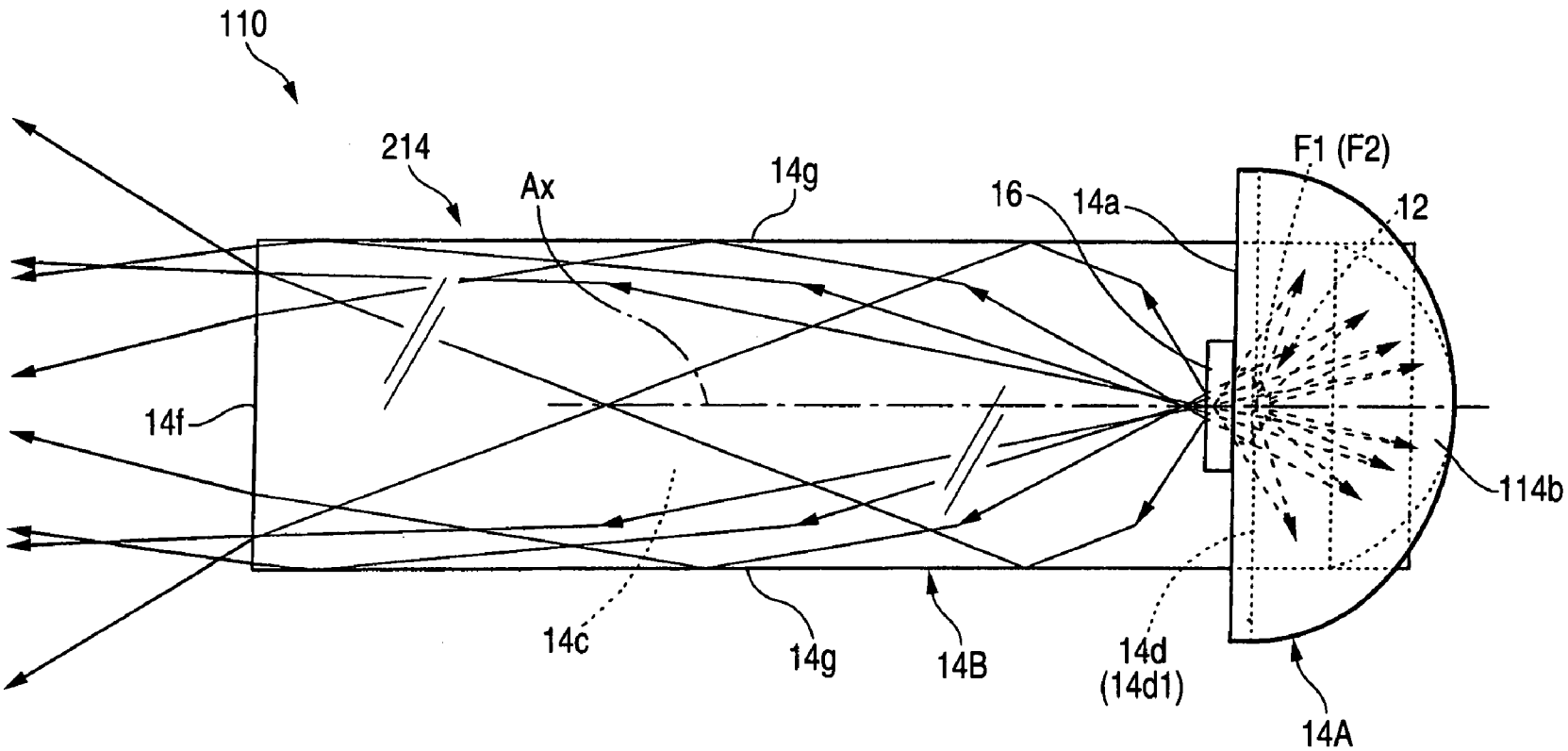
FIG. 6 is a plane view illustrating a vehicle illumination lamp according to a first modification of the exemplary embodiment.

FIG. 6 is a plane view illustrating a vehicle illumination lamp 110 according to the present modification.

As illustrated in the drawing, the vehicle illumination lamp 110 differs from the above exemplary embodiment in configuration of a first reflection surface 114*b* of a translucent block 114. However, elements other than that are completely analogous in configuration with those of the exemplary embodiment.

More specifically, as in the case of the first reflection surface 14*b* of the exemplary embodiment, a vertical cross-sectional profile along the optical axis Ax of the first reflection surface 114*b* of the present modification is formed into an elliptical shape whose first focal point F1 is at the luminous center of the light-emitting element 12, and whose second focal point F2 is at a point located vertically below the first focal point F1. However, a vertical cross-sectional profile orthogonal to the optical axis Ax of the first reflection surface 114*b* differs from that of the above embodiment in being formed into an elliptical shape whose eccentricity is larger than that of the above-mentioned elliptical shape. However, a position of the first focal point of the elliptical shape forming the vertical cross-sectional profile orthogonal to the optical axis Ax is set to a position analogous to the first focal point F1 of the above-mentioned elliptical shape.

In the present modification, light originated from the light-emitting element 12 and reflected by the first reflection surface 114*b* converges onto the lower edge 14*d*1 of the third reflection surface 14*d* while being spread over a certain width in the lateral direction, rather than converging to a single point of the second focal point F2 as in the case of the exemplary embodiment. As in the case of the above exemplary embodiment, substantially half of the light originated from the light-emitting element 12 and reflected by the first reflection surface 14*b* directly reaches the second reflection surface 14*c*; and the remaining substantially half of the light reaches the second reflection surface 14*c* after having been specularly reflected by the third reflection surface 14*d*. However, this occurs at an angle closer to the vertically downward direction than that in the above exemplary embodiment. Accordingly, the light reflected by the second reflection surface 14*c* diffuses over a smaller width as compared with the case of the above embodiment.

Figure 7:
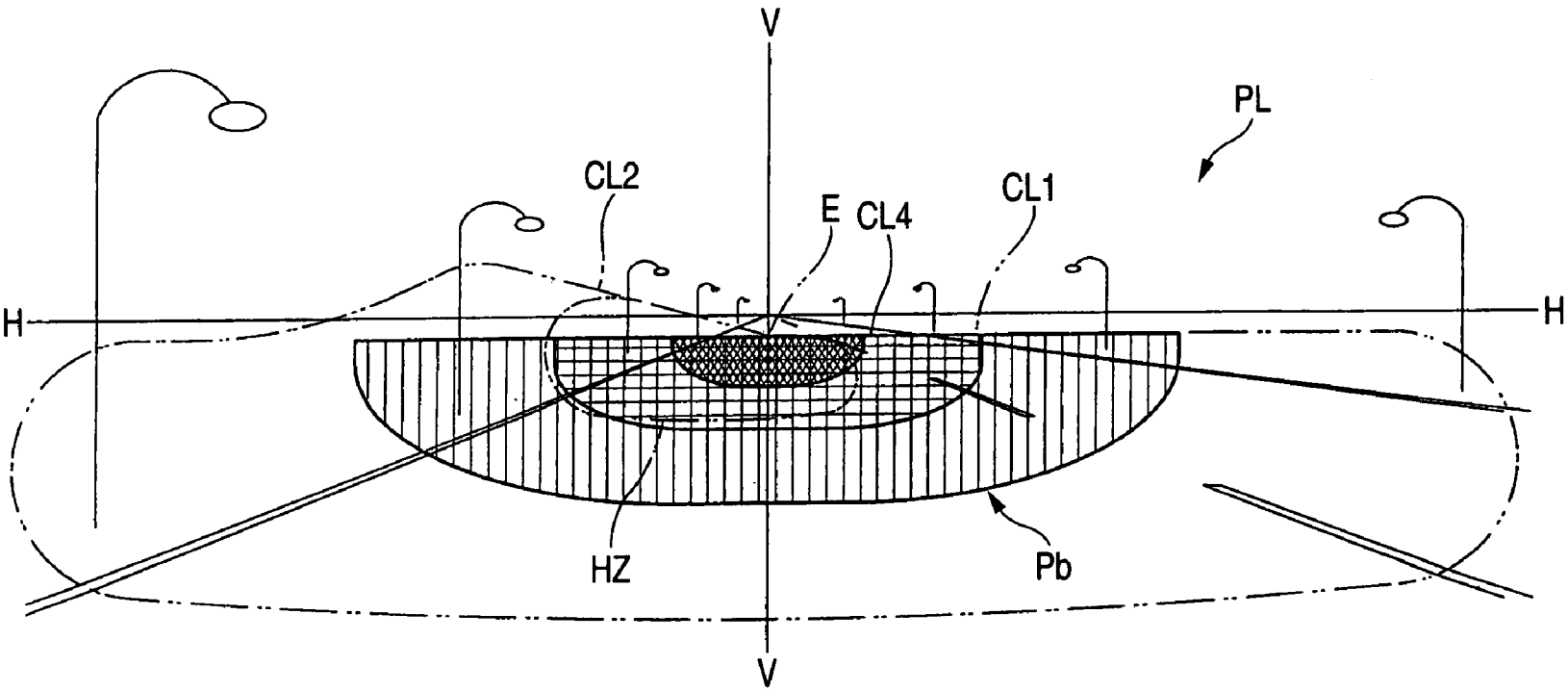
FIG. 7 is a perspective view illustrating a light distribution pattern formed from light illuminated forward from the vehicle illumination lamp according to the first modification on the virtual vertical screen.

FIG. 7 is a perspective view illustrating a light distribution pattern Pb formed from light illuminated forward from the vehicle illumination lamp 110 according to the present modification on a virtual vertical screen placed at a position 25*m* ahead of the vehicle.

As illustrated in the drawing, the light distribution pattern Pb is also formed, as a portion of the low-beam light distribution pattern PL indicated by a line constituted of short and long dashes, into a horizontally-elongated light distribution pattern having its center below and in the vicinity of the elbow point E.

The light distribution pattern Pb is also a light distribution pattern having a sharp cutoff line CL4 which extends in the horizontal direction. However, its lateral diffusion angle is smaller than that of the light distribution pattern Pa of the above embodiment. The reason therefor is that the light reflected from the second reflection surface 14*c* diffuses over a smaller width as compared with the case of the above exemplary embodiment.

When the configuration of the modification is employed, there can be formed the light distribution pattern Pb whose lateral diffusion angle is relatively small. The lateral diffusion angle of the light distribution pattern Pb can be increased or decreased by means of varying the eccentricity of the elliptical shape forming the vertical cross-sectional profile of the first reflection surface 14*b* orthogonal to the optical axis Ax.

Next, a second modification of the exemplary embodiment will be described.

Figure 8:
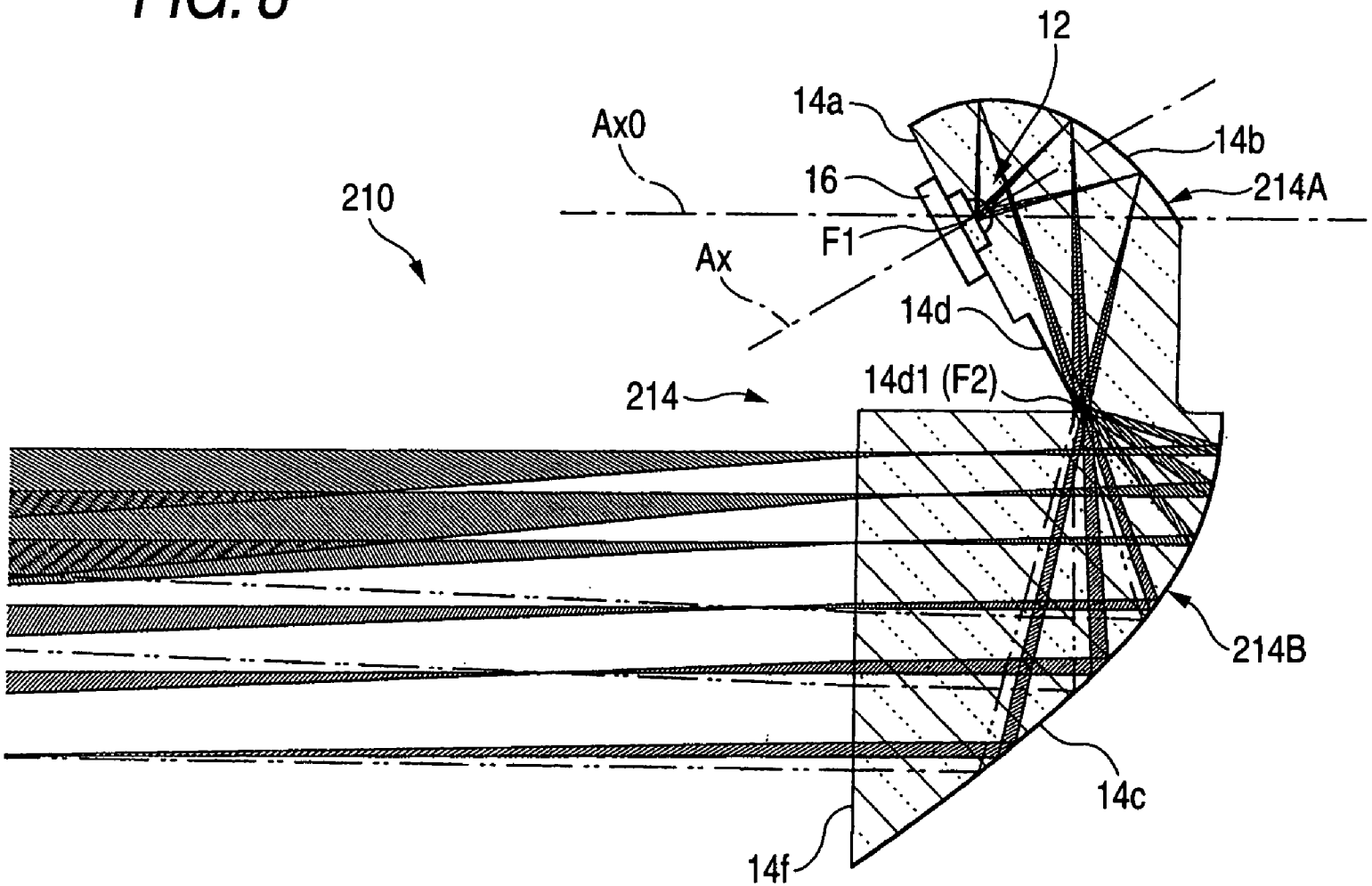
FIG. 8 is a side cross-sectional view illustrating a vehicle illumination lamp according to a second modification of the embodiment.

FIG. 8 is a side cross-sectional view illustrating a vehicle illumination lamp 210 according to the present modification.

As illustrated in the drawing, the vehicle illumination lamp 210 differs from the exemplary embodiment in an orientation of an upper structural section 214A and a size of a lower section 214B, both of which are elements of a translucent block 214. However, elements other than those are completely analogous in configuration with those of the exemplary embodiment.

More specifically, the upper structural section 214A has such a shape that the upper structural section 14A of the translucent block 14 of the embodiment is tilted forward by a predetermined angle (e.g., approximately 30 degrees) about the lower edge 14*d*1 of the third reflection surface 14*d*. As a result, the optical axis Ax is also tilted downward by the predetermined angle in relation to an axis Ax0 which extends in the longitudinal direction of the lamp. In addition, the first and third reflection surfaces 14*b* and 14*d* are also tilted forward by the predetermined angle.

Accordingly, the present modification is similar to the above exemplary embodiment in that the light originated from the light-emitting element 12 and reflected by the first reflection surface 14*b* converges to the second focal point F2. However, as compared with the embodiment, a position where the light is incident on the second reflection surface 14*c* is displaced in its entirety a long distance rearward in relation to the lamp. Since a front region of the lower section 214B is negated as a result of this displacement, a position of the front face 14*f* is set a long distance rearward as compared with the case of the exemplary embodiment.

Meanwhile, as in the case of the embodiment, the light originated from the light-emitting element 12 and reflected by the first reflection surface 14*b* reaches the second reflection surface 14*c* as light diverged from the second focal point F2. Accordingly, light having exited from the front face 14*f* of the lower structure 214B becomes light similar to that of the exemplary embodiment.

When the present modification is employed, the lower section 214B can be reduced in size as compared with the lower section 14B of the embodiment, thereby rendering the vehicle illumination lamp 210 compact in size.

A vehicle illumination lamp has the following configuration. A light-emitting element is disposed on an optical axis Ax which extends in a longitudinal direction of the lamp so as to face rearward in relation to the lamp. Light originated from the light-emitting element 12 is reflected in a downward direction by a first reflection surface 14*b* formed from a spheroid, to thus be temporarily converged to a second focal point F2 thereof, and thereafter reflected in a forward direction in relation to the lamp by a second reflection surface 14*c* formed from a parabolic cylindrical curved surface. In relation to the above, a third reflection surface 14*d* formed from a vertical plane orthogonal to the optical axis Ax is disposed below the light-emitting element 12; and a lower edge 14*d*1 of the third reflection surface 14*d* is set as a focal line of the parabolic cylindrical curved surface. By virtue of this configuration, both light which directly reaches the second reflection surface 14*c* and light which reaches the same by way of the third reflection surface 14*d* are rendered light from the rear of the focal line, thereby preventing light reflected by the second reflection surface 14*c* from becoming light oriented upward.

While the invention has been described with reference to the exemplary embodiment and modifications thereof, the technical scope of the invention is not restricted to the description of the exemplary embodiment and modifications. It is apparent to the skilled in the art that various changes or improvements can be made. It is apparent from the description of claims that the changed or improved configurations can also be included in the technical scope of the invention.

What is claimed is:

1. A vehicle illumination lamp, comprising:

a light-emitting element including an optical axis extending in a longitudinal direction of said lamp in plane view, said light-emitting element facing rearward in relation to said lamp, a first reflection surface for reflecting in a downward direction light originating from said light-emitting element, a second reflection surface for reflecting, forward in relation to said lamp, said lamp light originated from said light-emitting element and reflected by said first reflection surface, and a third reflection surface formed on a plane intersecting said optical axis in such a manner as to include a first focal point and a second focal point, said third reflection surface disposed below said light-emitting element so as to face rearward in relation to said lamp, wherein:

a vertical cross-sectional profile of said first reflection surface along said optical axis is a substantially elliptical shape including a first focal point in the vicinity of an illuminance center of said light-emitting element and a second focal point located below said first focal point;

a vertical cross-sectional profile of said second reflection surface along said optical axis is a substantially parabolic shape including a focal point that is said second focal point; and a lower edge of said third reflection surface extends in a horizontal direction at a vertical level of said second focal point.

2. The vehicle illumination lamp according to claim 1, wherein a surface shape of said first reflection surface is formed into a substantially spheroid shape.

3. The vehicle illumination lamp according to claim 2, wherein a surface shape of said second reflection surface is formed into a substantially parabolic, cylindrical curved surface shape whose focal line is at a lower edge of said third reflection surface.

4. The vehicle illumination lamp according to claim 3, wherein each of said first reflection surface, said second reflection surface, and said third reflection surface is formed from a reflection film formed on a surface of a single translucent block.

5. The vehicle illumination lamp according to claim 2, wherein each of said first reflection surface, said second reflection surface, and said third reflection surface is formed from a reflection film formed on a surface of a single translucent block.

6. The vehicle illumination lamp according to claim 5, wherein each of said first reflection surface, said second reflection surface, and said third reflection surface is formed from a reflection film formed on a surface of a single translucent block.

7. The vehicle illumination lamp according to claim 2, wherein each of said first reflection surface, said second reflection surface, and said third reflection surface is formed from a reflection film formed on a surface of a single translucent block.

8. The vehicle illumination lamp according to claim 1, wherein a surface shape of said second reflection surface is formed into a substantially parabolic, cylindrical curved surface shape whose focal line is at a lower edge of said third reflection surface.

9. The vehicle illumination lamp according to claim 8, wherein each of said first reflection surface, said second reflection surface, and said third reflection surface is formed from a reflection film formed on a surface of a single translucent block.

10. The vehicle illumination lamp according to claim 1, wherein each of said first reflection surface, said second reflection surface, and said third reflection surface is formed from a reflection film formed on a surface of a single translucent block.

11. The vehicle illumination lamp according to claim 1, wherein the optical axis of the light-emittting element is oriented downward with respect to the longitudinal direction of said lamp.

12. The illumination lamp according to claim 11, wherein a surface shape of said first reflection surface is formed into a substantially spheroid shape.

13. The illumination lamp according to claim 11, wherein a surface shape of said second reflection surface is formed into a substantially parabolic, cylindrical curved surface shape whose focal line is at a lower edge of said third reflection surface.

14. The illumination lamp according to claim 11, wherein each of said first reflection surface, said second reflection surface, and said third reflection surface is formed from a reflection film formed on a surface of a single translucent block.

15. An illumination lamp, comprising:

a light-emitting element including an optical axis, said light-emitting element facing rearward in relation to said lamp, a first reflection surface for reflecting light originating from said light-emitting element, a second reflection surface for reflecting, forward in relation to said lamp, said lamp light originated from said light-emitting element and reflected by said first reflection surface, and a third reflection surface formed on a plane intersecting said optical axis in such a manner as to include a first focal point and a second focal point, said third reflection surface facing rearward in relation to said lamp, wherein:

a vertical cross-sectional profile of said first reflection surface along said optical axis is a substantially elliptical shape including a first focal point in the vicinity of an illuminance center of said light-emitting element and a second focal point located below said first focal point;

a vertical cross-sectional profile of said second reflection surface along said optical axis is a substantially parabolic shape including a focal point that is said second focal point; and a lower edge of said third reflection surface extends in a horizontal direction at a vertical level of said second focal point.

16. The illumination lamp according to claim 15, wherein the optical axis of the light-emittting element is tilted with respect to the longitudinal direction of said lamp.

* * * * *